US008348480B2

(12) United States Patent
Chang

(10) Patent No.: US 8,348,480 B2
(45) Date of Patent: Jan. 8, 2013

(54) ADJUSTABLE STRUCTURE FOR LAMP STAND

(76) Inventor: Tsung-Chang Chang, Taipei (TW)

( * ) Notice: Subject to any disclaimer, the term of this patent is extended or adjusted under 35 U.S.C. 154(b) by 318 days.

(21) Appl. No.: 12/882,664

(22) Filed: Sep. 15, 2010

(65) Prior Publication Data

US 2012/0063152 A1 Mar. 15, 2012

(51) Int. Cl.
*F21V 21/20* (2006.01)

(52) U.S. Cl. ..... 362/401; 362/413; 362/414; 362/427

(58) Field of Classification Search ..... 362/401, 362/402, 410, 413, 414, 427; 248/514–517
See application file for complete search history.

(56) References Cited

U.S. PATENT DOCUMENTS 2,732,487 A * 1/1956 Crider ..... 362/410
5,613,771 A * 3/1997 Siverling ..... 362/401

* cited by examiner

*Primary Examiner* — Stephen F Husar
(74) *Attorney, Agent, or Firm* — Muncy, Geissler, Olds & Lowe, PLLC

(57) ABSTRACT

An adjustable structure for lamp stand, in which a swivel mount is fitted to the upper portion of a base, thereby enabling ends of a first bar support and a telescopic link to be pin connected to the swivel mount, while the other ends are pin connected to a second bar support. A lamp swivel component is disposed on the end of the second bar support. Accordingly, relative positions between the first bar support, the second bar support and the telescopic link can be freely adjusted, while still providing stable support to the structure.

4 Claims, 5 Drawing Sheets

ADJUSTABLE STRUCTURE FOR LAMP STAND

BACKGROUND OF THE INVENTION (a) Field of the Invention

The present invention relates to a lamp stand, and more particularly to a novel adjustable structure for a lamp providing means for adjusting at will the entire structure, while having a simple configuration, which can be conveniently assembled, and substantially reduces production costs.

(b) Description of the Prior Art

Referring to FIG. 1, which shows a lamp stand of the prior art, which has been widely used as a lamp stand by beautician professionals for many years, wherein a lamp stand 100 is primarily assembled from two sets of juxtaposed supporting rods 101, 102 mutually connected. Pivots 103, 104 are respectively disposed at rotation corner areas of the two sets of juxtaposed supporting rods 101, 102, and an end of the second set of supporting rods 102 enables a supplementary apparatus 107, such as a magnifying glass or an illuminating lamp, and the like, to be disposed thereon to enable the beautician professional to carry out beauty treatment.

And as depicted in the drawing, the end of the lamp stand 100 is fitted with a clamping mount 105, and a clamping chuck 106 is disposed on the clamping mount 105 so that the lamp stand 100 can be clamped to the edge of a tabletop using the clamping chuck 106.

In which, the two sets of juxtaposed supporting rods 101, 102 of the lamp stand 100 primarily use a set of springs (not shown in the drawing) located in the interior of the supporting rods 101, 102. When the two sets of juxtaposed supporting rods 101, 102 are adjusted to relative positions, then the elastic force of the springs is used to provide brace support and fixing of the supporting rods 101, 102.

However, because the aforementioned lamp stand structure requires that the springs be installed in the interior space of the supporting rods, thus, design of the fixing positions between the supporting rods must be extremely precise, otherwise, they will easily come apart. Furthermore, after adjusting the supporting rods and fixing positions thereof, an external force must be used to fixedly lock the pivots. Hence, slackening of the locking portions or pivot positions very easily occurs during the process of repeated tightening and loosening adjustment over a long period of time, making it difficult to fix positions thereof. Moreover, because assembly of such structures is complicated, and cost is high, thus, it is difficult to improve productivity, resulting in a decline in market competitiveness.

SUMMARY OF THE INVENTION

Hence, the object of the present invention is to provide an adjustable structure for lamp stand, which enables simplification of the entire structure, making for easy and more convenient assembly, and reducing production costs, thereby increasing market competitiveness.

The first objective of the present invention is to provide an adjustable structure for lamp stand that primarily uses an oil pressure type telescopic link disposed between bar supports to supplement position fixing of the structure, thereby preventing slackening of the structure because of elastic fatigue.

Another objective of the present invention is to provide the adjustable structure for lamp stand with a configuration comprising three components, including a first bar support, a second bar support and a telescopic link, therewith fabricating an easily adjustable structure enabling fixing position thereof, as well as providing simple and convenient assembly.

Yet another objective of the present invention is for the adjustable structure for lamp stand to extrude hollow aluminum material to form the first bar support and the second bar support, thereby enabling the structure to be lightweight and have low cost. The pin connected positions are equally fitted with soft sleevings to provide a friction fit, increase abrasion resistant properties, and extend the serviceable life of the entire structure.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
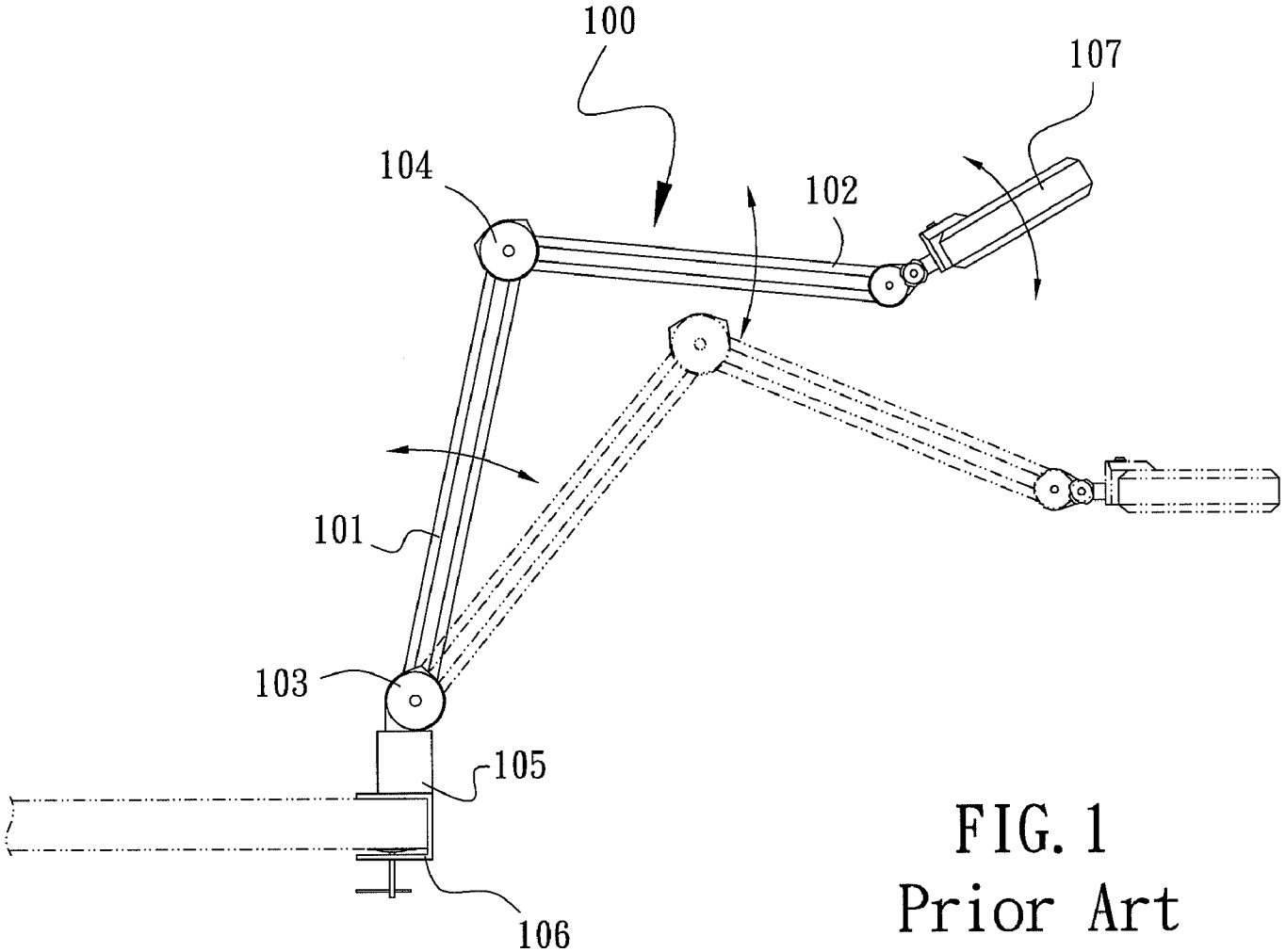
FIG. 1 Prior Art
FIG. 1 is a planar view depicting a lamp stand of the prior art.
Figure 2:
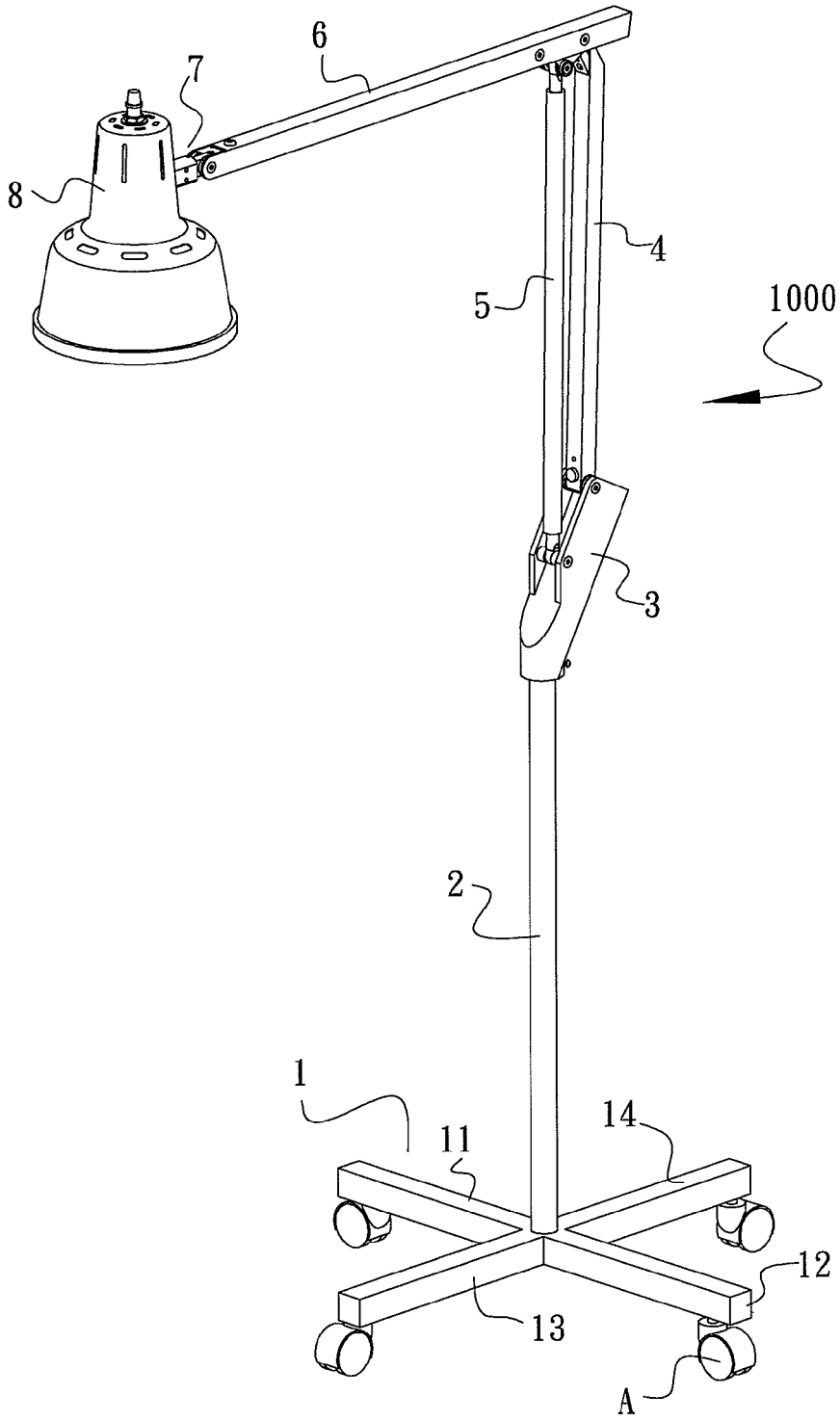
FIG. 2 is an elevational view of an adjustable structure for lamp stand of the present invention.

The adjustable structure for lamp stand of the present invention, as depicted in FIG. 2, consists of a lamp stand 1000 comprising a base 1, a standard bar 2, a swivel mount 3, a first bar support 4, a telescopic link 5, a second bar support 6 and a lamp swivel component 7.

In which, the base 1 is fitted with four cross bars 11, 12, 13, 14, and a bottom end of each of the cross bars 11, 12, 13, 14 is fitted with a sliding wheel A, thereby enabling sliding movement of the base 1.

The upper portion of the base 1 is fitted with the vertical standard bar 2, and the swivel mount 3 is disposed on the upper end of the standard bar 2. The swivel mount 3 assumes an inclined disposition, the upper surface of which is provided with two assembling hole mounts, respectively being upper hole mounts 31 and lower hole mounts 32 (see FIG. 3). The upper hole mounts 31 enable the bottom end of the first bar support 4 to be pin connected thereto, and the lower hole mounts 32 enable the bottom end of the telescopic link 5 to be pin connected thereto, thereby causing the first bar support 4 and the telescopic link 5 to be pin connected and positioned right up against the swivel mount 3 to enable swinging thereabout.

As depicted in the drawings, the upper ends of the first bar support 4 and the telescopic link 5 are respectively pin connected to the body of the second bar support 6 which can be arranged horizontally or inclined.

In which, the pin connected position of the first bar support 4 to the second bar support 6 enables front and rear pitch angle adjustment and fixing of the second bar support 6, while the pin connected position of the telescopic link 5 to the second bar support 6 provides support to the second bar support 6 through the telescopic link 5 regardless of the direction change in position or angle of the second bar support 6, thereby maintaining positioning of the second bar support 6.

Figure 5:
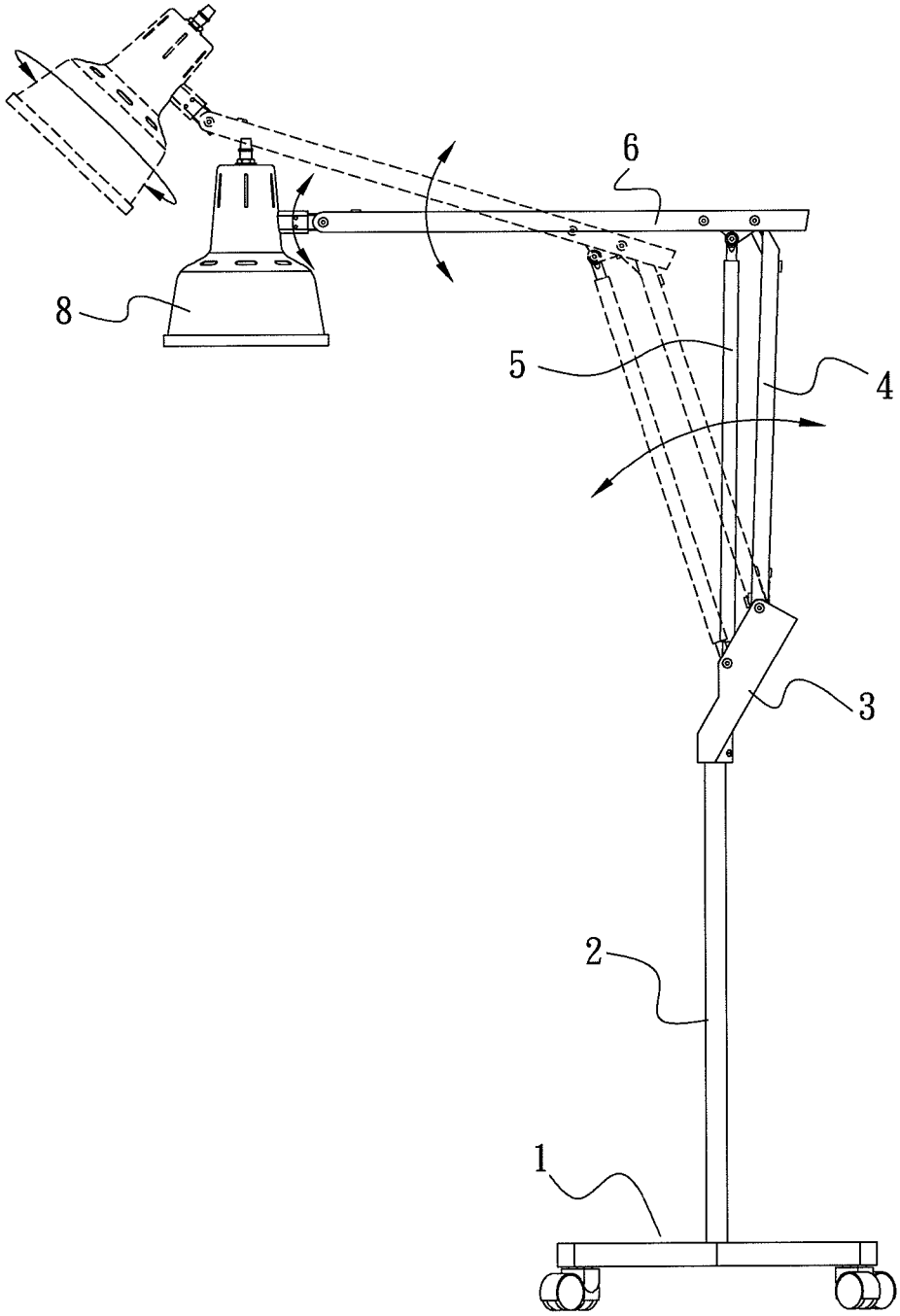
FIG. 5 is a schematic view depicting an operating state of the adjustable structure for lamp stand according to the present invention.

The lamp swivel component 7 is pivotal fitted to an end of the second bar support 6, thereby enabling the lamp swivel component 7 to not only use the pin connected position with the second bar support 6 to adjust the pitch angle of the lamp, but also, after assembling a light fitting 8, such as an illuminating lamp or a magnifying glass, to the front end thereof, enables axial rotation thereof (as depicted in FIG. 5).

Accordingly, the light fitting 8 assembled to the end of the second bar support 6 enables nearly 360 degrees multiposition adjustment in change of direction, thereby enabling adjustment to a suitable angle to suit different portions of the human body, and facilitate the beautician in carrying out their work.

Figure 3:
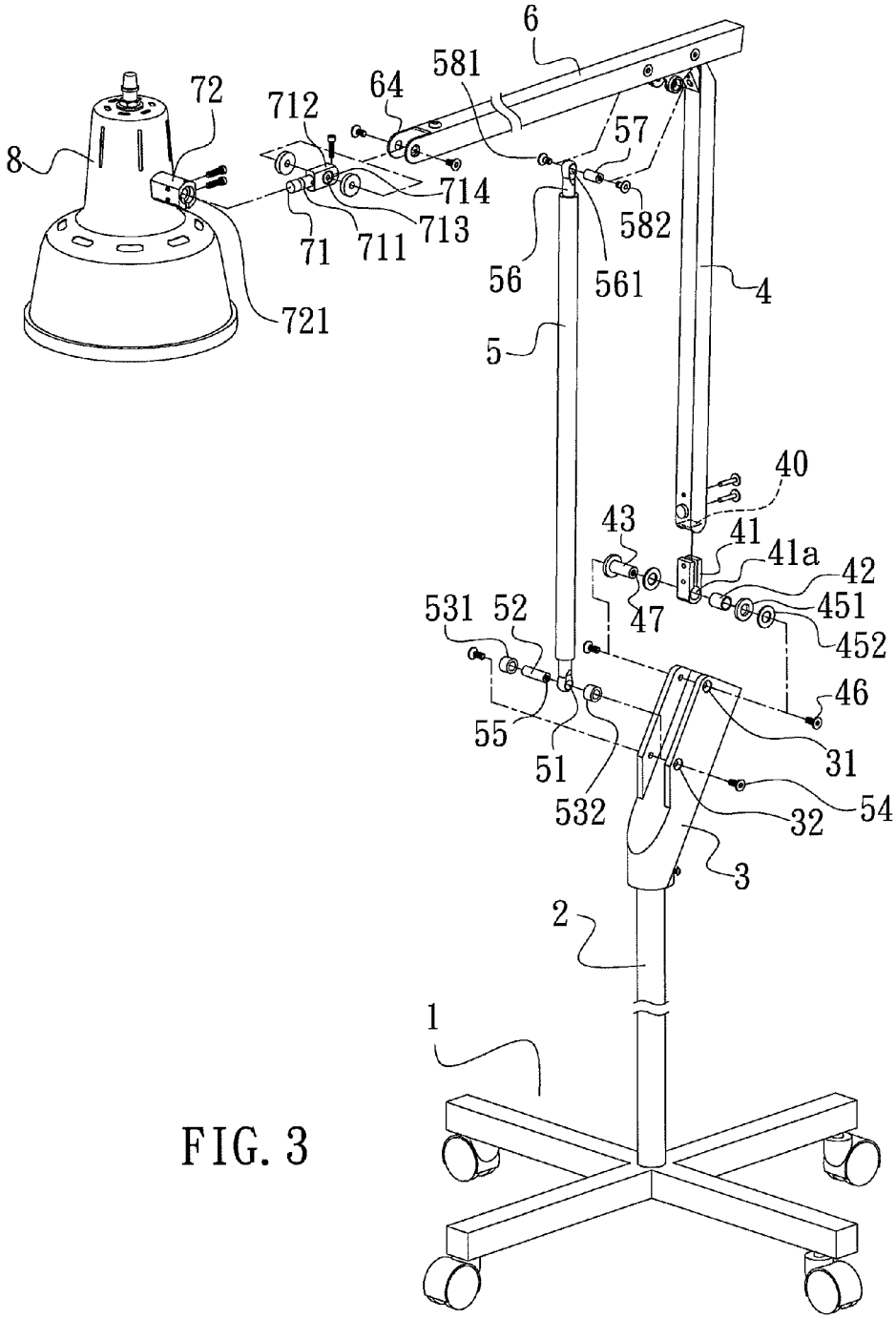
FIG. 3 is an exploded elevational view of the adjustable structure for lamp stand of present invention.

Regarding the detailed structure of the adjustable structure for lamp stand of the present invention, please refer to FIG. 3, which shows the swivel mount 3 disposed on the upper end of the standard bar 2, A narrow groove is formed between the upper hole mounts 31 and the lower hole mounts 32, thereby enabling the first bar support 4 and the telescopic link 5 to extend therein and be respectively assembled to the upper hole mounts 31 and the lower hole mounts 32 to form an integrated body. In which, the lower end of the first bar support 4 is provided with an inner hole 40 to enable a U-shaped clamping piece 41 to penetrate the first bar support 4 through the inner hole from the bottom of the first bar support 4 upwards, after which screws are used to fixedly lock the U-shaped clamping piece 41.

The bottom end of the U-shaped clamping piece 41 is provided with a transverse through hole 41*a*, an abrasion resistant copper collar 42 is mounted in the interior of the transverse through hole 41*a*, and a first bolt 43 is mounted in the interior of the abrasion resistant copper collar 42. Gasket rings 451, 452 are mounted on the first bolt 43 so as to be located on each of two sides of the abrasion resistant copper collar 42, and then screws 46 are used to lock into a screw hole 47 predefined in the interior of the first bolt 43 from an outer side of the upper hole mounts 31 of the swivel mount 3. Accordingly, one end of the first bar support 4 is pin connected to the upper hole mounts 31 of the swivel mount 3.

The aforementioned abrasion resistant copper collar 42 is primarily used to reduce frictional wear from repeated rotation and swinging over a long period of time. Moreover, the serviceable life of the entire structure is extended through use of the easily replaceable abrasion resistant copper collar 42.

The telescopic link 5 is an oil pressure type telescopic link, which is pivotally disposed to the lower hole mounts 32 of the swivel mount 3. And as depicted in the drawing, the bottom end of the telescopic link 5 is provided with a transverse through hole 51, and a second bolt 52 penetrates the interior of the transverse through hole 51. Plastic protective bushings 531, 532 are respectively mounted on the two ends of the second bolt 52 penetrating the transverse through hole 51, and screws 54 are used to lock into screw holes 55 predefined in the interior of the second bolt 52 from the outer sides of the lower hole mounts 32 of the swivel mount 3. Accordingly, one end of the telescopic link 5 is pin connected to the lower hole mounts 32 of the swivel mount 3.

Regarding pivotal disposition of the telescopic link 5 to the second bar support 6, as depicted in the drawing, the end of a telescopic pin 56 of the telescopic link 5 is provided with a pin hole 561, and a pin bolt 57 penetrates the pin hole 561, after which two screws 581, 582 are used to lock into two side screw holes of the pin bolt 57 from the two sides thereof, thereby enabling the telescopic link 5 to be pivotally disposed to the second bar support 6.

Figure 4:
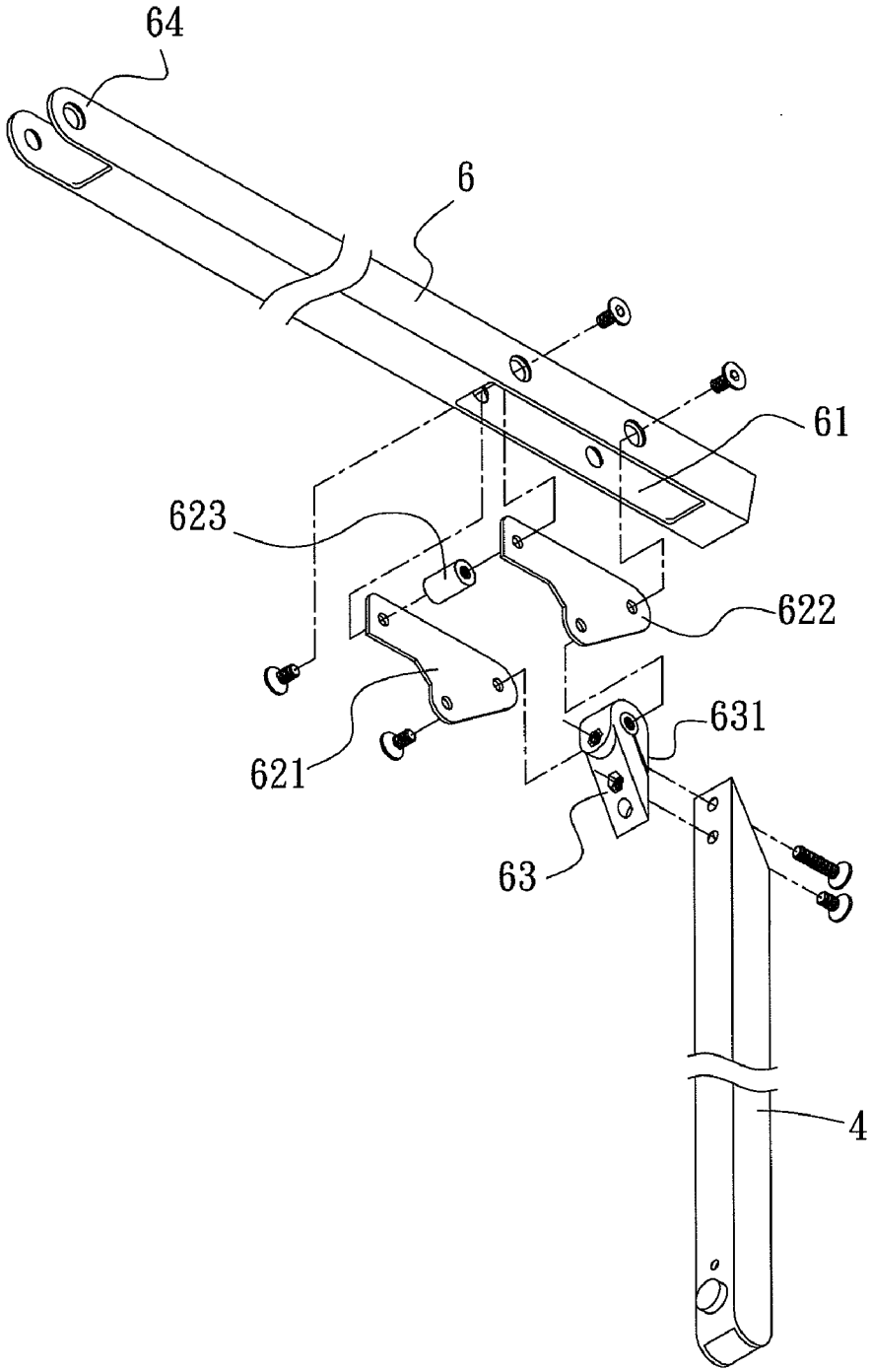
FIG. 4 is an exploded elevational view of the adjustable structure for lamp stand depicting a pin connecting portion between a first bar support and a second bar support according to the present invention.

Referring to FIG. 4, which depicts the pin connected means of the first bar support 4 to the second bar support 6, in which a long groove 61 is defined at a relative position in the second bar support 6. Protective plates 621, 622 are respectively locked to the inner two sides of the long groove 61, and the bodies of the protective plates 621, 622 are provided with locking holes, thereby enabling a bolt sleeve 623 to be used to fixedly lock the protective plates 621, 622 to the second bar support 6 using a screw to form an integrated body. A swivel piece 63 is fitted between the protective plates 621, 622, thereby enabling fixed locking to the second bar support 6 through use of the protective plates 621, 622 and the swivel piece 63. A long side 631 of the swivel piece 63 enables fixed locking to the first bar support 4 using screws, as well as enabling mutual rotation after pin connecting the first bar support 4 to the second bar support 6.

As depicted in FIG. 3, the lamp swivel component 7 is assembled from a shaft rod 71 and a sleeve 72, in which the rod portion of the shaft rod 71 is provided with an annular groove 711, and another end is fitted with a connecting portion 712. An end of the connecting portion 712 is provided with a mounting hole 713, in one side of which is formed a slot 714. The upper end of the connecting portion 712 is provided with a screw hole radially penetrating the slot 714. Accordingly, after bolt portions 64 fitted at the end of the second bar support 6 are used to mount onto the mounting hole 713 of the connecting portion 712, a screw is used to penetrate the screw hole, thereby enabling the shaft rod 71 to be pin connected to the second bar support 6. Moreover, the sleeve 72 is provided with an inner hole 721 enabling the shaft rod 71 to penetrate therethrough, and the outer portion of the sleeve 72 is provided with screw holes. After the shaft rod 71 penetrates the sleeve 72, then a screw is used to transversely penetrate the upper and lower sides of the annular groove 711, thereby enabling an annular mounting of the shaft rod 71 and the sleeve 72 to form an integrated body, after which the sleeve 72 is able to axially rotate around the shaft rod 71. Another end of the sleeve 72 enables the light fitting 8 to be mounted and assembled using one end socket, thereby enabling 360 degree rotary movement of the light fitting 8 using the sleeve 72, as well as front and rear pitch swinging using the pin connected position of the shaft rod 71 to the second bar support 6.

Referring to FIG. 5, according to the structure described above, implementation of the present invention involves molding both the first bar support 4 and the second bar support 6 from aluminum, thereby enabling the structure to have a lightweight feature, while maintaining a definite strength. The pin connected structure between the first bar support 4 and the second bar support 6 enables maintaining good movement therebetween when the first bar support 4 and the second bar support 6 are mutually rotating, as well as preventing the occurrence of frictional wear on a single side. Moreover, the telescopic link 5 disposed between the swivel mount 3 and the second bar support 6 enables the telescopic link 5 to be disposed beside the first bar support 4, thereby enabling the telescopic link 5 to be used to provide stable support to the second bar support 6 regardless of whether placed in a horizontal disposition or an inclined disposition, and thus forming a structure that is easily assembled, light and convenient, as well as being easy to use.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An adjustable structure for lamp stand, comprising:

a base, wherein a standard bar is fitted to an upper portion of the base, and a swivel mount is fitted to an upper portion of the standard bar, the swivel mount assumes an inclined disposition, and is provided with an upper hole mount and a lower hole mount;

a first bar support, wherein a lower end of the first bar support is provided with an inner hole to enable an U-shaped clamping piece to penetrate into an interior of the first bar support through the inner hole, after which screw is used to fixedly lock the U-shaped clamping piece; a bottom end of the U-shaped clamping piece is provided with a transverse through hole, an abrasion resistant copper collar is mounted in an interior of the transverse through hole, and a first bolt penetrates an interior of the abrasion resistant copper collar, whereupon the first bolt is used to pin connect to the upper hole mount of the swivel mount;

a telescopic link, wherein the telescopic link is an oil pressure type telescopic link, a bottom end of the telescopic link is provided with a through hole, and a second bolt is mounted in an interior of the through hole, a screw hole is formed in each of the two ends of the second bolt, and the second bolt is used to pin connect to the lower hole mount of the swivel mount;

a second bar support, wherein the second bar support is pin connected to upper ends of the first bar support and the telescopic link, when the second bar support is swinging relative to the first bar support, then the telescopic link supplements support of the second bar support; moreover, a bolt portion fitted at an end of the second bar support;

a lamp swivel component, wherein the lamp swivel component is pivotally disposed on the bolt portion of the second bar support, and another end of the lamp swivel component is fitted with a lamp fitting; accordingly, linkage of said components enables free angular adjustment and positioning of the lamp fitting.

2. The adjustable structure for lamp stand according to claim 1, wherein the second bar support is provided with a long groove at the position where the first bar support is pin connected thereto, protective plates are respectively locked to two sides of an interior of the long groove, and the bodies of the protective plates are provided with locking holes, thereby enabling a bolt sleeve to be used to fixedly lock the protective plates to the second bar support using a screw to form an integrated body; a swivel piece is further fitted between the protective plates, and another side of the swivel piece enables fixed locking to the first bar support, thereby enabling relative rotation after assembling the first bar support to the second bar support.

3. The adjustable structure for lamp stand according to claim 1, wherein the lamp swivel component is assembled from a shaft rod and a sleeve, a rod portion of the shaft rod is provided with an annular groove, and another end is fitted with a connecting portion, an end of the connecting portion is provided with a mounting hole, and a slot is formed in one side of the mounting hole, the upper end of the connecting portion is provided with a screw hole radially penetrating the slot, accordingly, the bolt portion fitted at the end of the second bar support is used to mount onto the mounting hole of the connecting portion, and a screw is used to penetrate the screw hole, after which the connecting portion is able to achieve a pin connection between the shaft rod and the second bar support; moreover, the sleeve is provided with an inner hole enabling the shaft rod to penetrate therethrough, and an outer portion of the sleeve is provided with a set of transverse screw holes, after the shaft rod is made to penetrate the sleeve, then a screw is used to penetrate the upper and lower sides of the annular groove, thereby enabling an annular mounting of the shaft rod and the sleeve to form an integrated body; another end of the sleeve enables a light fitting to be assembled thereto, after which the light fitting is able to axially rotate using the sleeve and the shaft rod, as well as enabling front and rear pitch swinging using the pin connected position of the shaft rod to the second bar support.

4. The adjustable structure for lamp stand according to claim 1, wherein the lower end of the standard bar is fitted with the base, the base being assembled from four cross bars in a square crossing configuration, and a bottom end of each of the cross bars is fitted with a sliding wheel.

* * * * *